United States Patent [19]

Johnson

[11] 4,131,963

[45] Jan. 2, 1979

[54] SKI BINDING

[76] Inventor: Knute N. Johnson, 1005 Haslam Ave., Victoria, B.C., Canada, V9B 2N3

[21] Appl. No.: 866,110

[22] Filed: Dec. 30, 1977

[51] Int. Cl.[2] ..... A63C 5/00

[52] U.S. Cl. ..... 9/310 AA; 280/11.3

[58] Field of Search ..... 280/11.3, 623, 625, 280/616; 9/310 AA, 310 A

[56] References Cited

U.S. PATENT DOCUMENTS

| | | | |
|---|---|---|---|
| 3,114,562 | 12/1963 | Goodman | 280/11.3 |
| 3,508,288 | 4/1970 | Lockwood | 9/310 AA |

FOREIGN PATENT DOCUMENTS

| | | | |
|---|---|---|---|
| 442431 | 11/1948 | Italy | 9/310 AA |

*Primary Examiner*—Trygve M. Blix
*Assistant Examiner*—D. W. Keen
*Attorney, Agent, or Firm*—Townsend and Townsend

[57] ABSTRACT

A binding for a ski has a toe end and a heel end. An instep portion secures the instep of a skier's foot. A heel portion secures the heel of the skier's foot. The instep portion and the heel portion are connected to the ski and a foot opening is provided between the instep portion and the heel portion. A mechanism is provided for permitting the binding to move away from the ski near the foot opening to increase the size of the foot opening so the skier's foot can be inserted easily into the binding, and for permitting the binding to be flattened against the ski after the foot is inserted so the foot is firmly held within the binding for skiing.

15 Claims, 12 Drawing Figures

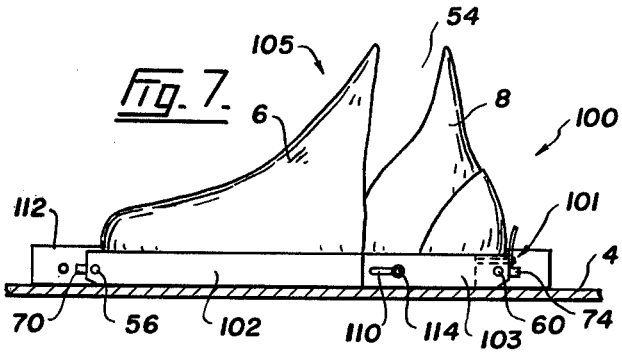
Fig. 7.
105
54
6
8
100
112
101
4
70
56
102
110
114
103
60
74
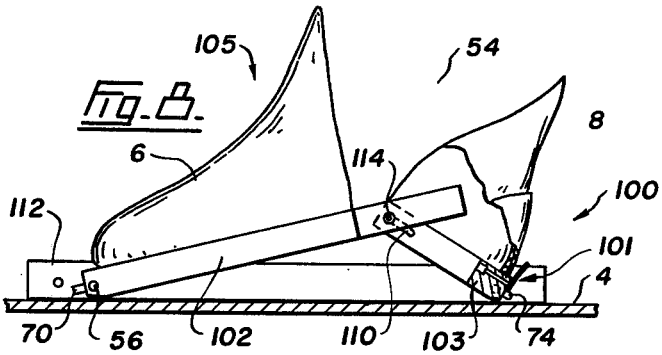
Fig. 8.
105
54
8
6
114
100
112
101
4
70
56
102
110
103
74
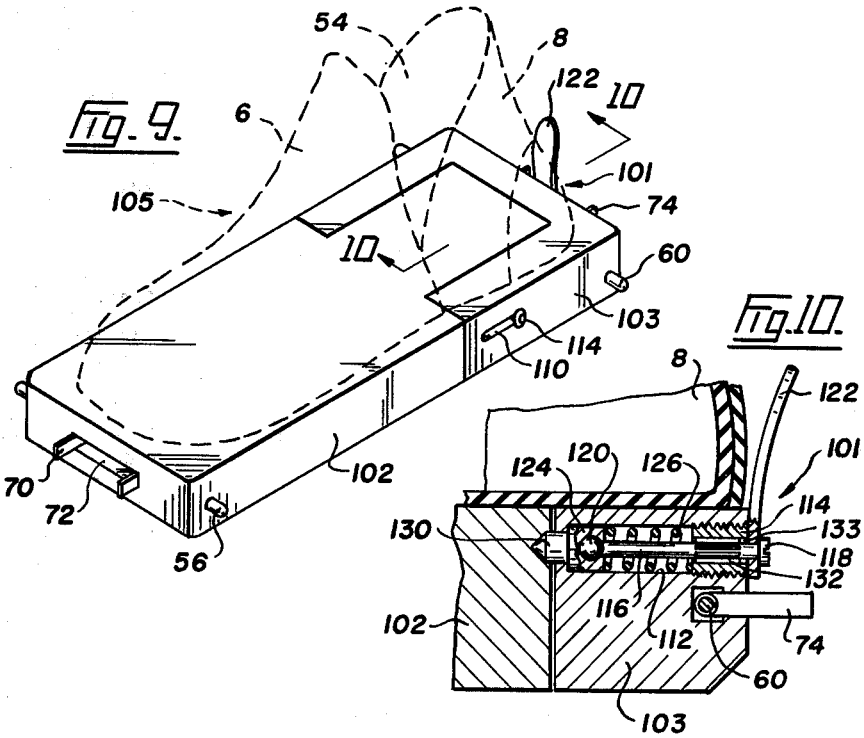
Fig. 9.
54
8
122
10
6
101
105
74
10
60
103
114
110
70
72
102
56
Fig. 10.
8
122
101
124
120
126
114
133
130
118
132
116
102
112
74
60
103

SKI BINDING

BACKGROUND OF THE INVENTION

Particularly in the sport of water skiing, the need has been felt for an improved binding for securing the skier's foot on each ski. The resilient bindings commonly used in water skiing must hold the skier's feet firmly and the degree of firmness is increased for competitive water skiing and particularly for freestyle competition. At the same time, if the skier's feet are held to firmly, the feet will not be released during a twist or fall and this may result in broken legs or other serious injury. Additionally, it is very difficult for the water skier to fit his feet within the tight bindings required for the firm support just mentioned. There is a need, therefore, for a binding which allows a skier's foot to be easily inserted and yet firmly secured once within the binding and which, at the same time, releases the skier's foot when sufficient forces are encountered which would cause injury to the skier.

SUMMARY OF THE INVENTION

According to this invention, there is provided a boot for a ski. The boot has a toe end and heel end and comprises: an instep portion for securing the instep of a skier's foot; a heel portion for securing the heel of the skier's foot; means for connecting the instep portion and the heel portion to the ski; a foot opening between the instep portion and the heel portion; and releasable means permitting the boot to move away from the ski near the foot opening to increase the size of the foot opening so the skier's foot can be inserted easily into the boot and permitting the boot to be flattened against the ski after the foot is inserted, so the foot is firmly held within the boot for skiing.

In drawings which illustrate embodiments of the invention:

FIG. 7 is a side elevational view of a ski binding according to a second embodiment of the invention;

FIG. 8 is a side elevational view, shown partly in section, of the binding of FIG. 7 in position for insertion of the skier's foot;

FIG. 9 is an isometric view of the boot portion of the binding shown in FIGS. 7 and 8.

FIG. 10 is a sectional view taken along section 10—10 of FIG. 9, showing the latch mechanism adjacent the heel;

DESCRIPTION OF THE PREFERRED EMBODIMENTS

Figure 1:
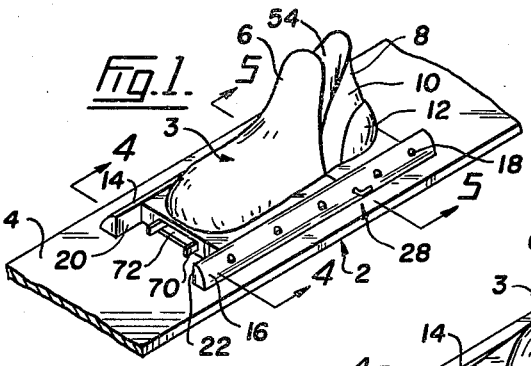
FIG. 1 is an isometric view of a ski binding according to an embodiment of the invention, showing the boot flattened against the ski for use.
Figure 2:
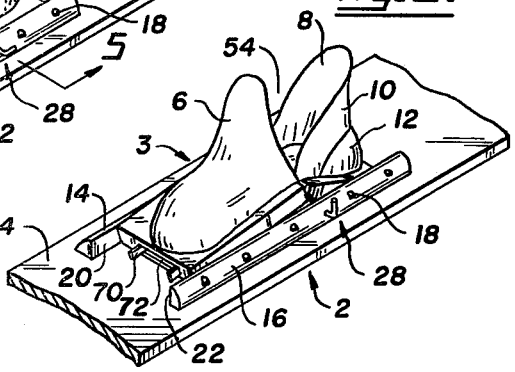
FIG. 2 is an isometric view of the binding shown in FIG. 1 but showing the boot lifted away from the ski adjacent the foot opening for insertion of the skier's foot.

A first embodiment of the invention is illustrated in FIGS. 1 to 6 respectively, wherein like parts are numbered the same. Referring first to FIG. 1, the binding 2 is used for securing a skier's foot to a ski 4. The binding 2 has a boot 3, shown best in FIG. 3, comprising an instep portion 6 for securing the instep of the skier's foot and a heel portion 8 for securing the heel of the skier's foot. The instep portion 6 is made of a suitable resilient material such as rubber while the heel portion 8 has an upper portion 10 of a similar resilient material and a lower portion 12 of a more rigid material such as a suitable plastic.

A pair of rails 14 and 16 are secured by a plurality of screws 18 to the ski 4 to each side of the instep portion 6 and the heel portion 8 in parallel relationship. In the preferred embodiment, rails 14 and 16 are made of aluminum but other suitable materials such as nylon could be employed. The rails 14 and 16 have generally flat opposed faces 20 and 22 perpendicular to the ski 4.

Figure 6:
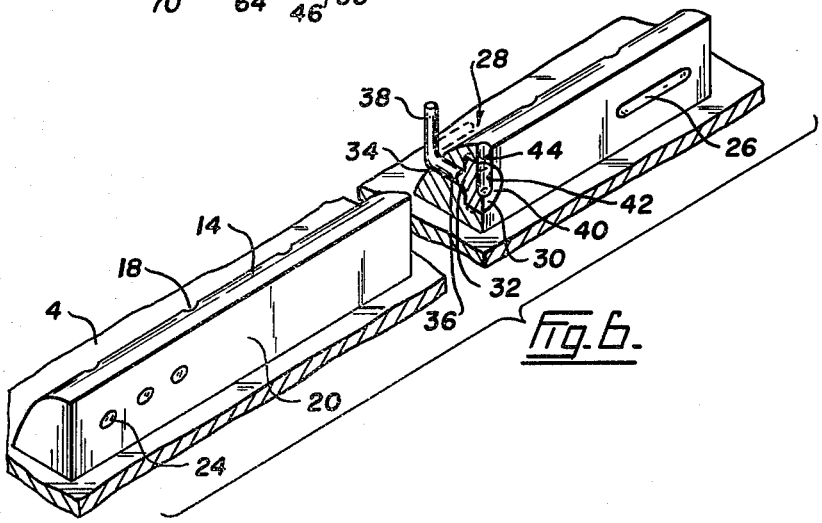
FIG. 6 is an enlarged isometric view of a rail portion of the binding shown in FIG. 1, with the central latch mechanism shown in section.

As seen in FIG. 6, face 20 of rail 14 is provided with a number of recesses. Face 22 of rail 16 is a mirror image of face 20 of rail 14 and has a corresponding set of recesses. A series of three circular recesses 24 are provided along the horizontal center line of face 20 adjacent the toe end of instep portion 6. Near the opposite end of rail 14, horizontally elongate recess 26 is provided adjacent the heel end of heel portion 8. Between recesses 24 and recess 26 a latch mechanism 28 is provided. The latch mechanism 28 has a cylindrical portion 30 rotatable within a corresponding cylindrical socket 32 of rail 14. A shaft 34 is connected near the center of cylinder 30, on the side of cylinder 30 distal face 20 of rail 14, by suitable means such as welding. The shaft 34 is rotatable within a corresponding aperture 36 in rail 14. Shaft 34 is bent at a right angle adjacent the side of rail 14 opposite face 20 to form a lever 38. The end 40 of cylinder 30 is generally flush with face 20 of rail 14 and is provided with a recess 42 extending from near the center of end 40 to the outer edge of cylinder 30. A recess 44 is located above cylinder 30 on face 20 of rail 14 and extends upwardly to communicate with the top of rail 14. In the position of lever 38 shown in solid lines in FIG. 6, the bottom of recess 44 communicates with recess 42 of cylinder 30.

Figure 3:
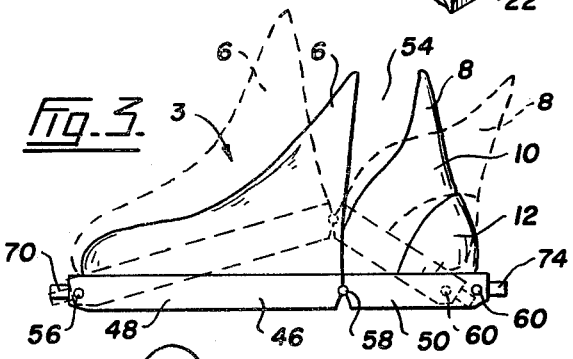
FIG. 3 is a side elevational view of the boot portion of the binding shown in FIGS. 1 and 2, with the boot shown in broken lines in position for insertion of the skier's foot.

As best seen in FIG. 3, the binding 2 is also provided with a sole portion 46 comprising a forward portion 48 and a rearward portion 50. The forward portion 48 is connected to the lower peripheral edge of instep portion 6 by a suitable adhesive. Similarly, the rearward portion 50 is connected along a lower peripheral edge of heel portion 8. The forward portion 48 and the rearward portion 50 of sole portion 46 are connected by a hinge 52, as seen in FIG. 5, adjacent foot opening 54 and between instep portion 6 and heel portion 8.

Figure 4:
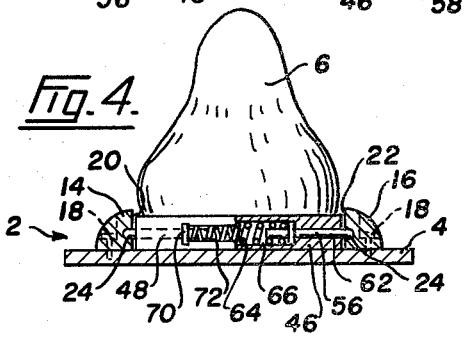
FIG. 4 is a sectional view taken along section 4—4 of FIG. 1.

Referring firstly to FIG. 3, it may be seen that sets of laterally projecting pins 56, 58 and 60 are provided on sole portion 46 adjacent the toe, hinge and heel respectively. As seen in FIG. 4, the pins 56 adjacent the toe end are laterally slidable within corresponding apertures 62 in sole portion 46. A coil spring 64 is located within a larger cylindrical aperture 66 in sole portion 46 and between levers 70. Referring to FIGS. 1 and 4, levers 70 are connected to pins 56 and project forwardly through rectangular aperture 72 at the front of forward portion 48 of sole portion 46. The pins 60 at the heel end of the binding 2 are similarly spring loaded and provided with levers 74 as shown in FIG. 3. The mechanism is the same as for pins 56 and, consequently, is not shown in detail. The pins 58, as shown in FIG. 5, are integral and comprise the central shaft for hinge 52.

The operation of the binding illustrated in FIGS. 1 to 6 is as follows: The boot 3 of the binding 2, as seen in FIG. 3, is positioned with pins 56 above recesses 24 in rails 14 and 16. The appropriate recess 24 of each of the rails 14 and 16 is chosen according to the size of the particular boot to be secured to the ski. Levers 70 are then squeezed together to retract pins 56 within apertures 62 of sole portion 46, as seen in FIG. 4, so the sole portion 46 can be positioned between faces 20 and 22 of rails 14 and 16 respectively. Levers 70 are then released so that pins 56 project into the appropriate recesses 24 in rails 14 and 16, as shown in FIG. 4. Similarly, levers 74, as shown in FIG. 3, are squeezed together and pins 60 positioned in elongate recesses 26 near the opposite ends of rails 14 and 16. Instep portion 6 and heel portion 8 are moved away from the ski 4 by bending sole portion 46 about hinge 52, as shown in dotted lines in FIG. 3. The foot of the skier is then placed within the instep portion 6 and the heel portion 8 through foot opening 54. With the lever 38 in the vertical position, as shown in FIG. 6, the skier pushes downwards with his foot against sole portion 46 until pins 58 enter recesses 44 in rails 14 and 16. With levers 38 in this position, the pins 58 can be moved downwardly until they rest against the ends of recesses 42 in cylinders 30 adjacent the centers of the cylinders. Levers 38 are then rotated downwards to the position shown in dotted lines in FIG. 6 and the pins 58 are retained within recesses 42 and prevented from moving upwards. As seen best in FIG. 3, pins 60 move closer to pins 56 when the boot 3 is lifted away from the ski 4 adjacent hinge 52. The horizontally elongate nature of recesses 26 allow for this movement.

Figure 5:
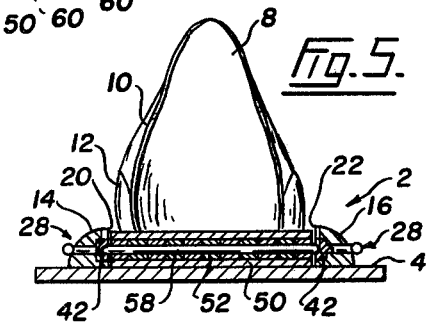
FIG. 5 is a sectional view taken along section 5—5 of FIG. 1.

As best seen in FIG. 5, the recesses 42 are relatively shallow and engage with a short rounded portion of pins 58. Consequently, should large forces be placed on the binding 2, for example if the skier falls, the pins 58 will disengage from recesses 42, releasing the skier's foot from the binding 2 to prevent injury.

A second embodiment of the invention is shown in FIGS. 7 to 10. This embodiment is similar to the one illustrated in FIGS. 1 to 6 and will be described only with reference to the differences therebetween. Referring to FIGS. 8 and 9, the boot 105 of binding 100 is provided with a relatively rigid sole portion 102 extending from the toe to the heel of the binding. When the binding 100 is lifted away from the ski 4 adjacent the hinge 114, as shown in FIG. 8, the back end of sole portion 102 lifts away from heel portion 8 and peripheral sole portion 103 to which heel portion 8 is connected. A latch member 101 is provided at the heel end of binding 100. Referring to FIG. 10, a cylindrical aperture 112 extends forwardly from the back of peripheral sole portion 103. Aperture 112 has a threaded portion near the outer end thereof. Within the threaded portion of aperture 112 a collar 114 is threadedly engaged. Shaft 116 has a slotted head 118 at the end external to peripheral sole portion 103 and a ball 102 at the end closest to sole portion 102. Shaft 116 passes through an aperture in lever 122. A splined portion 132 of shaft 116 passes through correspondingly splined aperture 133 in collar 114. Ball 120 is received in a corresponding socket in latch bolt 124. A coil spring 126 is compressed between collar 114 and latch bolt 124 within aperture 112. Latch bolt 124 has a pointed end extending forwardly from peripheral heel portion 103 through a portion of aperture 112 of reduced diameter to engage with a corresponding recess 130 in sole portion 102.

Because of splines 132 on shaft 116, and the corresponding splines of aperture 133 of collar 114, as shaft 116 is turned, collar 114 is moved inwardly and outwardly with respect to aperture 112 in peripheral heel portion 103. Since this changes the distance between collar 114 and latch bolt 124, the pressure of spring 126 therebetween is adjustable. Turning the head 118 of shaft 116 clockwise, increases the spring pressure and turning it counter-clockwise decreases the spring pressure. Consequently, the force engaging latch bolt 124 with recess 130 of sole portion 102 is adjustable. This provides an adjustable release mechanism so the force which will release the skier's foot from the binding can be varied.

By using latch mechanism 101, the need for latch mechanism 28 adjacent the hinges, as in the embodiment shown in FIGS. 1 to 6, is eliminated. Additionally, the incorporation of the latch mechanism 101 into the boot portion 105 allows the boot portion to be removed from the ski and employed as a normal boot. Consequently, this embodiment is particular suitable for snow skiing.

In most respects, the binding shown in FIGS. 7 to 10 is similar to that illustrated in FIGS. 1 to 6. However, instead of having elongate recesses 26 at the heel end of the rails, an elongate slot 110 is provided in peripheral sole portion 103 adjacent hinge 114, permitting relative movement between instep portion 6 and heel portion 8 as the boot 105 moves away from the ski 4. As seen in FIG. 8, the hinge 114 moves towards the front of the slot 110 as the boot moves away from the ski near the foot opening 54.

In order to move the boot away from the ski to the position shown in FIG. 8, lever 122 is pulled outwardly and, pivoting about its lower end, this pulls shaft 116 outwardly, disengaging latch bolt 124 from recess 130 on sole portion 102. The boot portion 105 is then pulled away from the ski to the position shown in FIG. 8 and the skier's foot is inserted. After the foot is inserted, the foot pushes the boot portion downwardly towards the ski and, again, lever 102 is pulled outwardly to allow sole portion 102 to flatten against the ski 4, as shown in FIG. 7, and is thereafter released to engage latch bolt 124 in recess 130. If excessive forces act upon the binding, as during a fall, spring 126 will be compressed and latch bolt 124 disengaged from recess 130. As mentioned, the force releasing the skier's foot depends upon the adjustment made on head 118 of the shaft 116.

Figure 11:
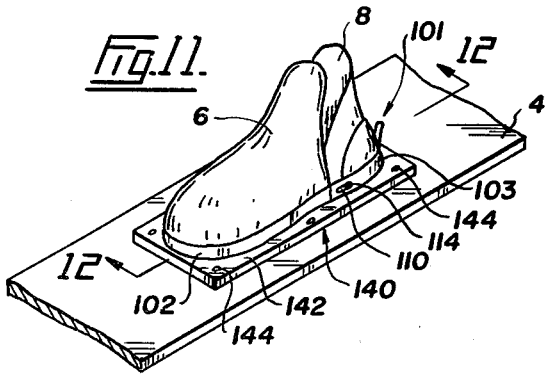
FIG. 11 is an isometric view of a ski binding according to a third embodiment of the invention.
Figure 12:
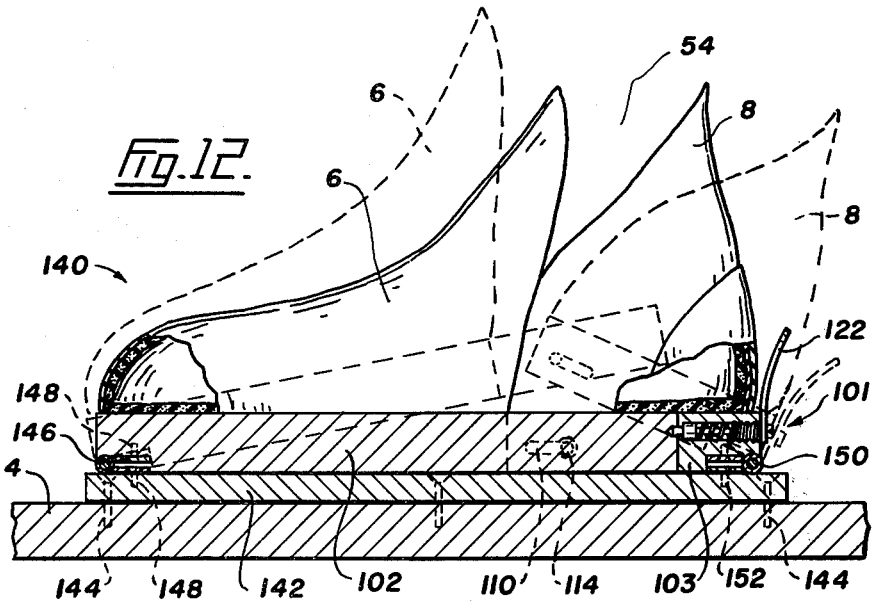
FIG. 12 is a sectional view taken along section 12—12 of FIG. 11.

A third embodiment of the invention is shown in FIGS. 11 and 12. This embodiment is essentially similar to that shown in FIGS. 7 to 10. Here, however, rails 112 are eliminated along with levers 70 and 74 and the boot portion 140 is permanently mounted on the ski 4. For this purpose, a rectangular mounting plate 142 is attached to the ski 4 with suitable screws 144. The instep portion of the binding is attached to the mounting plate 142 by hinge 146 at the toe end thereof. Hinge 146 is connected to the sole portion 102 and to the mounting plate 142 by screws 148. Similarly, hinge 150 is connected to peripheral sole portion 103 and to mounting plate 142 by screws 152. Similar to the embodiment shown in FIGS. 7 to 10, a latch mechanism 101 is provided near the heel end of the binding and a slot 110 is provided in peripheral sole portion 103. The skier's foot is inserted in the same way as with the previous embodiment, however, in this case, the boot portion is not removable from the ski other than by removing screws 144.

Other embodiments are within the scope of the invention, for example, the projections could be on the rails for the embodiments shown in FIGS. 1 to 10 with the recesses on the boot portion. Additionally, for the embodiment shown in FIGS. 1 to 6, the latch mechanism 28 could be provided on the boot portion of the binding with the projections on rails 14 and 16.

What I claim is:

1. A boot for a ski, the boot having a toe end and a heel end and comprising:

an instep portion for securing the instep of a skier's foot;

a heel portion for securing the heel of the skier's foot;

a foot opening between the instep portion and the heel portion;

means for pivotally connecting the instep portion to the ski near the toe end of the boot so that the instep portion can swing away from the ski adjacent the foot opening, generally about the toe end of the boot, when the boot is permitted to move away from the ski near the foot opening;

means for pivotally connecting the heel portion to the ski near the heel end of the boot so that the heel portion can swing away from the ski adjacent the foot opening, generally about the heel end of the boot, when the boot is permitted to move away from the ski near the foot opening; and releasable means permitting the boot to move away from the ski near the foot opening to increase the size of the foot opening so the skier's foot can be inserted easily into the boot and permitting the boot to be flattened against the ski after the foot is inserted so the foot is firmly held within the boot for skiing.

2. A boot as claimed in claim 1, wherein the instep portion is hingedly connected to the heel portion adjacent the foot opening.

3. A boot as claimed in claim 2, including a sole portion connected along a peripheral edge of the instep portion.

4. A binding comprising a boot as claimed in claim 3 in combination with a mounting means connectable to the ski, the means for connecting the instep portion and the means for connecting the heel portion comprising corresponding projections and recesses of the boot and of the mounting means.

5. A binding as claimed in claim 4, wherein at least one of said means for connecting includes elongate recesses so that the toe end of the boot can move towards the heel end of the boot when the boot is moved away from the ski adjacent the foot opening, and so that the toe end can be moved away from the heel end when the boot is flattened against the ski adjacent the foot opening.

6. A binding as claimed in claim 4, the mounting means comprising a pair of rail members connectable to the ski by suitable means, such as screws, one rail member to each side of the boot.

7. A binding as claimed in claim 6, the means for connecting comprising lateral projections to each side of the instep portion, lateral protections to each side of the heel portion and recesses on sides of the rail members facing the projections and corresponding in position to the projections.

8. A binding as claimed in claim 7, the instep portion of the boot and an upper part of the heel portion of the boot being of a suitable resilient material, such as rubber.

9. A binding as claimed in claim 8, the heel portion having a lower part of a more rigid material, such as a suitable plastic.

10. A binding as claimed in claim 8, the sole portion of the boot being connected to the heel portion along a peripheral edge generally adjacent the ski and including hinge means between the instep portion and the heel portion, generally adjacent the the foot opening.

11. A binding as claimed in claim 10, the releasable means comprising corresponding projections and recesses on the boot generally adjacent the hinge means and on the rail members.

12. A binding as claimed in claim 11, each recess being located on a generally cylindrical latch mechanism rotatable within a socket in each rail member, the recesses being on a generally circular end of each latch mechanism facing the hinge means on the boot and extending from generally near the center of the end to a peripheral edge of the end, the projections extending laterally from each side of the boot adjacent the hinge means, each latch mechanism being rotatable from a position where the recess is generally vertical and communicates with a top surface of the rail member for inserting each projection in the corresponding recess, to a horizontal position where the boot is held flat against the ski by the projections being restrained from movement away from the ski by the corresponding latch mechanisms.

13. A binding as claimed in claim 12, the projections for securing the heel portion and the instep portion including resiliently biased latch mechanisms for disengaging the projections from the corresponding recesses.

14. A boot as claimed in claim 3, the releasable means comprising a latch mechanism for connecting the sole portion to the heel portion generally adjacent the heel end of the boot.

15. A boot as claimed in claim 14, the boot having slidable means adjacent the boot opening permitting the instep portion of the boot to move away from the heel portion as the boot moves away from the ski adjacent the foot opening.

* * * * *